US011280041B2

(12) United States Patent
Wright et al.

(10) Patent No.: US 11,280,041 B2
(45) Date of Patent: Mar. 22, 2022

(54) ADDITIVE DISPENSER FOR VARYING THE TYPES OF ADDITIVES WITHIN A WASHING MACHINE APPLIANCE

(71) Applicant: Haier US Appliance Solutions, Inc., Wilmington, DE (US)

(72) Inventors: Troy Marshall Wright, Louisville, KY (US); Rose Marie Connelly, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 143 days.

(21) Appl. No.: 16/750,175

(22) Filed: Jan. 23, 2020

(65) Prior Publication Data

US 2021/0230785 A1 Jul. 29, 2021

(51) Int. Cl.

| | |
|---|---|
| ***D06F 39/02*** | (2006.01) |
| ***D06F 39/14*** | (2006.01) |
| ***D06F 23/04*** | (2006.01) |

(52) U.S. Cl.

CPC ..... *D06F 39/02* (2013.01); *D06F 23/04* (2013.01); *D06F 39/14* (2013.01)

(58) Field of Classification Search

None

See application file for complete search history.

(56) References Cited

U.S. PATENT DOCUMENTS

2005/0241347 A1* 11/2005 Cho ..... D06F 39/028 68/243
2014/0109620 A1* 4/2014 Yoon ..... D06F 39/088 68/12.18
2017/0327991 A1* 11/2017 Leibman ..... D06F 39/028
2017/0350060 A1* 12/2017 Favaro ..... D06F 39/028
2019/0226138 A1 7/2019 Tartuferi et al.

FOREIGN PATENT DOCUMENTS

| | | | |
|---|---|---|---|
| CN | 101457462 B | 1/2011 | |
| EP | 2048275 A1 * | 4/2009 | ..... D06F 39/02 |
| EP | 3037582 A1 | 6/2016 | |

OTHER PUBLICATIONS

ELECTROLUX, Understanding Your Detergent Dispenser & What to Use, https://www.youtube.com/watch?v=xyXzYadIZMM, Apr. 22, 2019.

* cited by examiner

*Primary Examiner* — Cristi J Tate-Sims
(74) *Attorney, Agent, or Firm* — Dority & Manning, P.A.

(57) ABSTRACT

A washing machine appliance, as provided herein, may include a cabinet, a tub, a basket, and a fluid additive dispenser. The cabinet may have a top panel. The tub may define a wash chamber. The basket may be rotatably mounted within the tub. The fluid additive dispenser may include a housing, a dispenser drawer, a primary cup, and a secondary cup. The housing may be mounted below the top panel. The dispenser drawer may be selectively received in the housing above the basket. The dispenser drawer may define a primary compartment and a secondary compartment. The primary cup may be selectively received within the primary compartment and define a vertical opening therethrough to permit a first wash additive to the primary compartment. The secondary cup may be selectively received within the secondary compartment and define a vertical opening therethrough to permit the second wash additive to the secondary compartment.

16 Claims, 8 Drawing Sheets

ADDITIVE DISPENSER FOR VARYING THE TYPES OF ADDITIVES WITHIN A WASHING MACHINE APPLIANCE

FIELD OF THE INVENTION

The present subject matter relates generally to automated washing appliances, such as washing machine appliances, and more particularly to an additive dispensing assembly for supplying a wash fluid to a washing appliance.

BACKGROUND OF THE INVENTION

Modern washing appliances, such as washing machine appliances and dishwasher appliances, often include an additive dispenser to dispense a wash fluid therefrom. Prior to use of a washing appliance, a wash additive, such as detergent, may be placed within the additive dispenser (e.g., by a user) to be selectively added to a wash chamber during a wash cycle of the appliance. For example, washing machine appliances generally include a tub for containing water or wash fluid (e.g., water and detergent, bleach, or other wash additives), as well as a basket that is rotatably mounted within the tub and defines a wash chamber for receipt of articles for washing. During normal operation of such washing machine appliances, the wash liquid is directed into the tub and onto articles within the wash chamber and basket.

Some users enjoy using single-cycle volumes of a specific wash additive. Such wash additives may be supplied (e.g., as a powder, liquid, additive pod, or scent pellet) in an amount suitable for only a single wash load or washing operation. Thus, a user may be free to use various different wash additives in different loads, since a new dose of wash additive must be provided for each new load.

Although some users enjoy the flexibility of using single-cycle volumes of wash additives, most existing washing machine appliances are not especially well-tailored to accept more than one or two types of additives. For example, one or two liquid compartments may be provided to selectively dispense liquid additives. Any other wash additives; such as a powder detergent, additive pod, or scent pellet; must be supplied directly to the basket. Unfortunately, this often limits the efficacy or use cases of the washing machine appliance. In certain cases, supplying a wash additive directly into the basket may risk damaging the articles therein. In the case of powder detergents or scent pellets, the wash additive may dissolve too early in the washing operation, especially if a prewash, soak, or rinse cycle is selected. In the case of additive pods, the additive pod may be prevented from fully dissolving (or dissolving at the appropriate time), which may leave an undesirable residue or unused amount of wash additive. Even conventional washing machine appliances that include pod-dispensers may struggle with adequate dilution and consistent performance when using additive pods.

As a result, there is a need for improved additive dispensers. In particular, it would be advantageous to provide an additive dispenser that could accommodate multiple different types of wash additives. Additionally or alternatively, it would be advantageous to provide an additive dispenser that can ensure improved dissolution of an additive pod during a washing operation.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet, a tub, a basket, and a fluid additive dispenser. The cabinet may have a top panel. The top panel of the cabinet may define an opening. The tub may be disposed within the cabinet below the top panel. The tub may define a wash chamber. The basket may be rotatably mounted within the tub. The fluid additive dispenser may include a housing, a dispenser drawer, a primary cup, and a secondary cup. The housing may be mounted below the top panel. The dispenser drawer may be selectively received in the housing above the basket. The dispenser drawer may define a primary compartment and a secondary compartment. The dispenser drawer may further define a primary outlet and a secondary outlet. The primary outlet may extend from the primary compartment to direct a primary wash fluid to the basket. The secondary outlet may extend from the secondary compartment to direct a secondary wash fluid to the basket. The primary cup may be selectively received on the dispenser drawer within the primary compartment to hold a first wash additive therein. The primary cup may define a vertical opening therethrough to permit the first wash additive to the primary compartment upstream from the primary outlet. The secondary cup may be selectively received on the dispenser drawer within the secondary compartment to hold a second wash additive therein. The secondary cup may define a vertical opening therethrough to permit the second wash additive to the secondary compartment upstream from the secondary outlet.

In another exemplary aspect of the present disclosure, a washing machine appliance is provided. The washing machine appliance may include a cabinet, a tub, a basket, and a fluid additive dispenser. The cabinet may have a top panel. The top panel of the cabinet may define an opening. The tub may be disposed within the cabinet below the top panel. The tub may define a wash chamber. The basket may be rotatably mounted within the tub. The fluid additive dispenser may include a housing, a dispenser drawer, a primary cup, and a secondary cup. The housing may extend between an open front end and a closed rear end. The housing may be mounted below the top panel. The dispenser drawer may be selectively received in the housing above the basket. The dispenser drawer may define a primary compartment and a secondary compartment spaced apart from the primary compartment by a lateral void. The dispenser drawer may further define a primary outlet and a secondary outlet. The primary outlet may extend from the primary compartment to direct a primary wash fluid to the basket. The secondary outlet may extend from the secondary compartment to direct a secondary wash fluid to the basket. The primary cup may be selectively received on the dispenser drawer within the primary compartment to hold a first wash additive therein. The primary cup may define a vertical opening therethrough to permit the first wash additive to the primary compartment upstream from the primary outlet. The secondary cup may be selectively received on the dispenser drawer within the secondary compartment to hold a second wash additive therein. The secondary cup may define a vertical opening therethrough to permit the second wash additive to the secondary compartment upstream from the secondary outlet.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
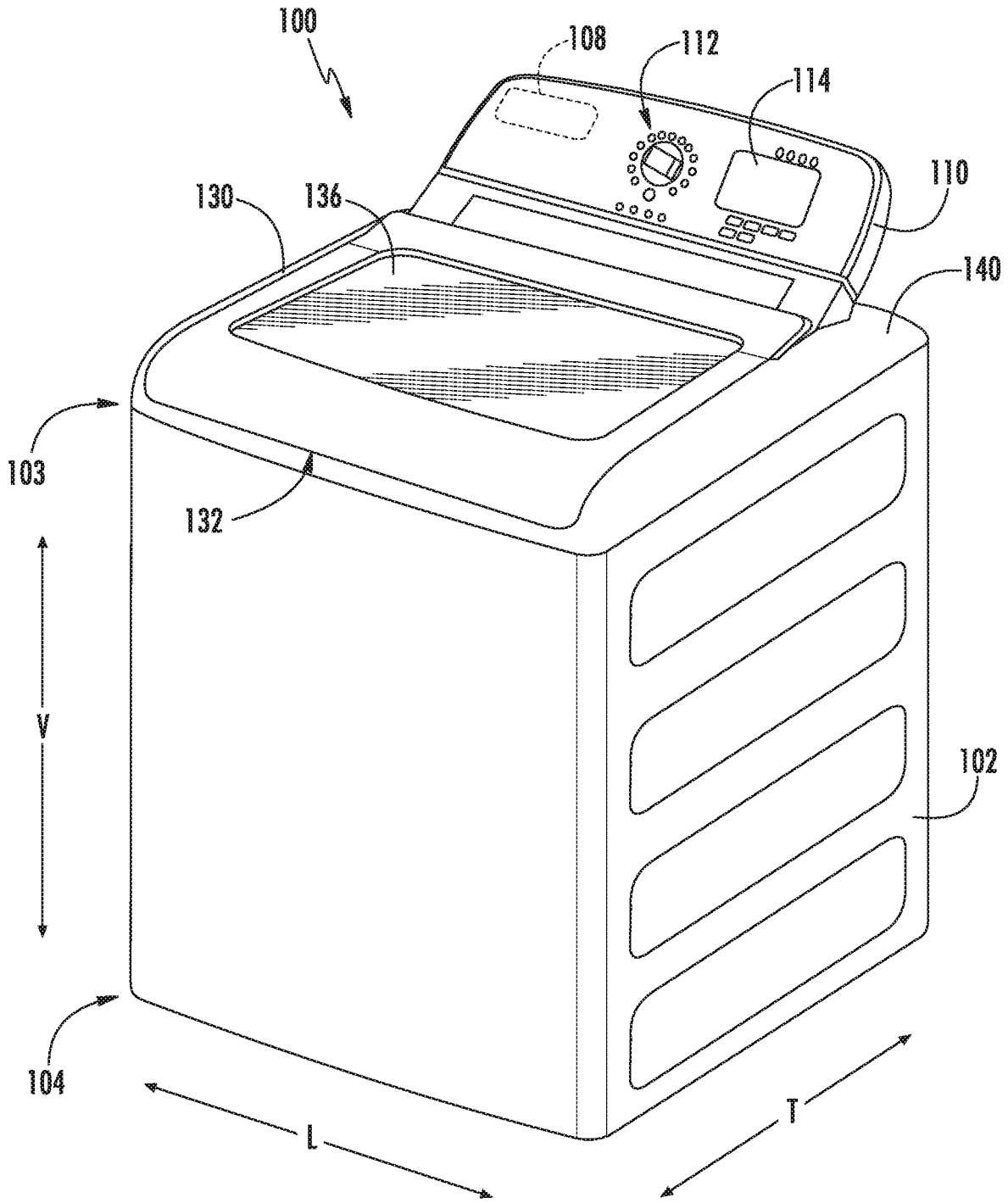
FIG. 1 provides a perspective view of a washing machine appliance according to exemplary embodiments of the present disclosure with a door of the washing machine appliance shown in a closed position.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
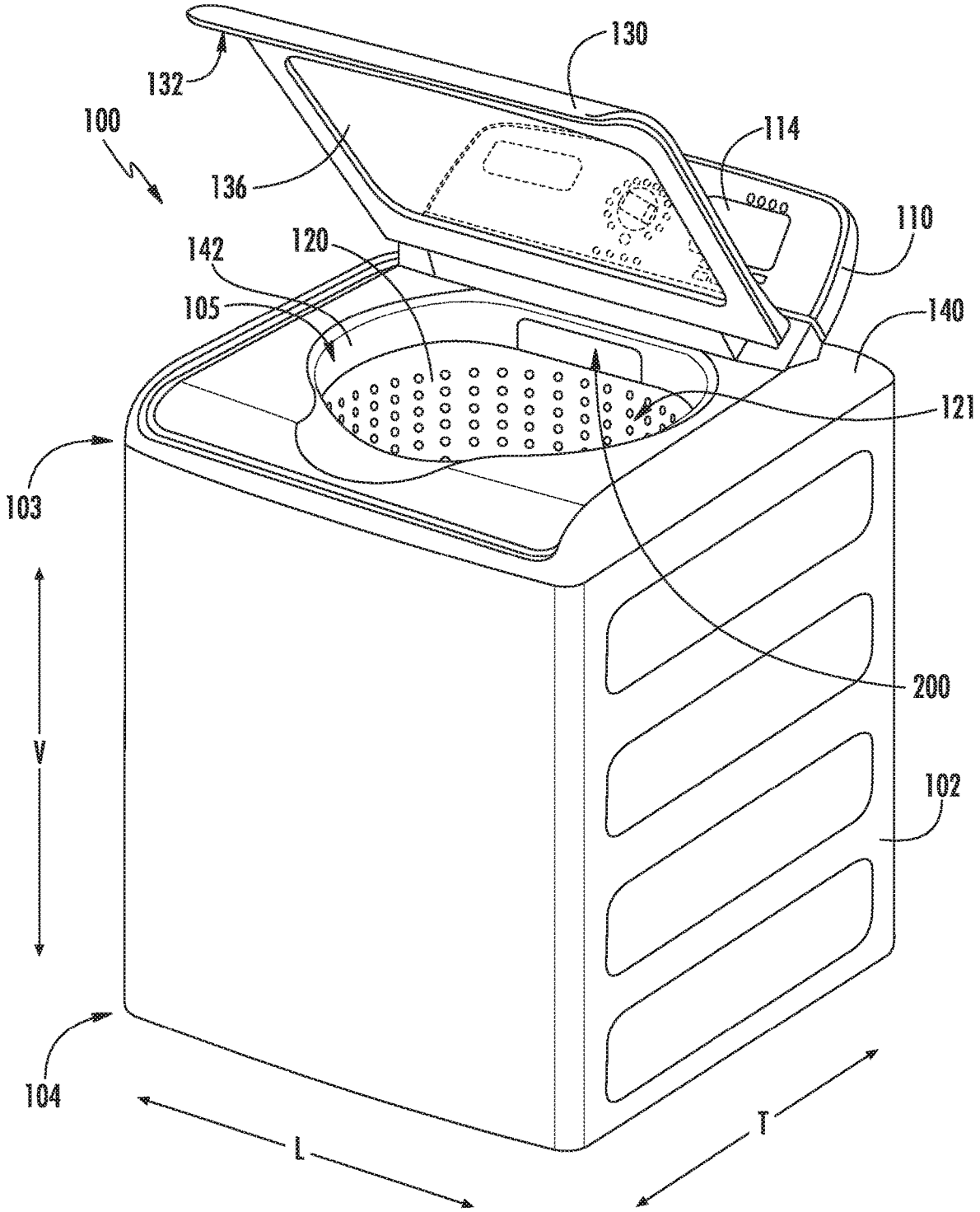
FIG. 2 provides a perspective view of the exemplary washing machine appliance of FIG. 1 with the door shown in an open position.

Turning now to the figures, FIGS. 1 and 2 illustrate an exemplary embodiment of a washing appliance. Specifically, the washing appliance is illustrated as a vertical axis washing machine appliance 100. In FIG. 1, a lid or door 130 is shown in a closed position. In FIG. 2, door 130 is shown in an open position. Washing machine appliance 100 generally defines a vertical direction V, a lateral direction L, and a transverse direction T, each of which is mutually perpendicular, such that an orthogonal coordinate system is defined.

While described in the context of a specific embodiment of vertical axis washing machine appliance 100, using the teachings disclosed herein it will be understood that vertical axis washing machine appliance 100 is provided by way of example only. Other washing appliances having different configurations, different appearances, or different features may also be utilized with the present subject matter as well (e.g., horizontal axis washing machines).

Washing machine appliance 100 has a cabinet 102 that extends between a top portion 103 and a bottom portion 104 along the vertical direction V. A wash basket 120 is rotatably mounted within cabinet 102. A motor (not shown) may be in mechanical communication with wash basket 120 to selectively rotate wash basket 120 (e.g., about a rotation axis during an agitation or a rinse cycle of washing machine appliance 100). Wash basket 120 is received within a wash tub or wash chamber 121 and is configured for receipt of articles for washing. The wash tub 121 holds wash and rinse fluids for agitation in wash basket 120 within wash tub 121. In optional embodiments, an agitator or impeller (not shown) extends into wash basket 120 and is also in mechanical communication with the motor. The impeller may assist agitation of articles disposed within wash basket 120 during operation of washing machine appliance 100.

In some embodiments, cabinet 102 of washing machine appliance 100 has a top panel 140. Top panel 140 defines an opening 105 that permits user access to wash basket 120 of wash tub 121. Door 130, which may be rotatably mounted to top panel 140, permits selective access to opening 105. In particular, door 130 selectively rotates between the closed position shown in FIG. 1 and the open position shown in FIG. 2. In the closed position, door 130 inhibits access to wash basket 120. Conversely, in the open position, a user can access wash basket 120. In optional embodiments, a window 136 in door 130 permits viewing of wash basket 120 when door 130 is in the closed position (e.g., during operation of washing machine appliance 100). Door 130 also includes a handle 132 that, for example, a user may pull or lift when opening and closing door 130. Further, although door 130 is illustrated as mounted to top panel 140, alternatively, door 130 may be mounted to another portion of cabinet 102 or any other suitable support.

In certain embodiments, a control panel 110 with at least one input selector 112 extends from top panel 140. Control panel 110 and input selector 112 collectively form a user interface input for operator selection of machine cycles and features. A display 114 of control panel 110 indicates selected features, operation mode, a countdown timer, or other items of interest to appliance users regarding operation. Operation of washing machine appliance 100 may be controlled by a controller or processing device 108 connected (e.g., electrically coupled) to control panel 110 for user manipulation to select washing machine cycles and features. In response to user manipulation of control panel 110, controller 108 operates the various components of washing machine appliance 100 to execute selected machine cycles and features.

Controller 108 may include a memory (e.g., non-transitive media) and microprocessor, such as a general or special purpose microprocessor operable to execute programming instructions or micro-control code associated with a washing operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 108 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 110 and other components of washing machine appliance 100 may be in communication with controller 108 via one or more signal lines or shared communication busses.

In some embodiments, during operation of washing machine appliance 100, laundry items are loaded into wash basket 120 through opening 105, and a washing operation is initiated through operator manipulation of input selectors 112. Wash basket 120 is filled with water and detergent or other fluid additives via an additive dispenser 200, which will be described in detail below. One or more valves can be controlled by washing machine appliance 100 to provide for filling wash basket 120 to the appropriate level for the volume or number of articles being washed or rinsed. By way of example for a wash cycle, once wash basket 120 is properly filled with fluid, the contents of wash basket 120 can be agitated (e.g., with an impeller as discussed previously) for washing of laundry items in wash basket 120.

After the agitation phase of the wash cycle is completed, wash basket 120 can be drained. Laundry articles can then be rinsed by again adding fluid to wash basket 120 depending on the specifics of the washing operation selected by a user. The impeller may again provide agitation within wash basket 120. One or more spin cycles also may be used. In particular, a spin cycle may be applied after the wash cycle or after the rinse cycle to wring wash fluid from the articles being washed. During a spin cycle, wash basket 120 is rotated at relatively high speeds. After articles disposed in wash basket 120 are cleaned or washed, the user can remove the articles from wash basket 120 (e.g., by reaching into wash basket 120 through opening 105).

Figure 3:
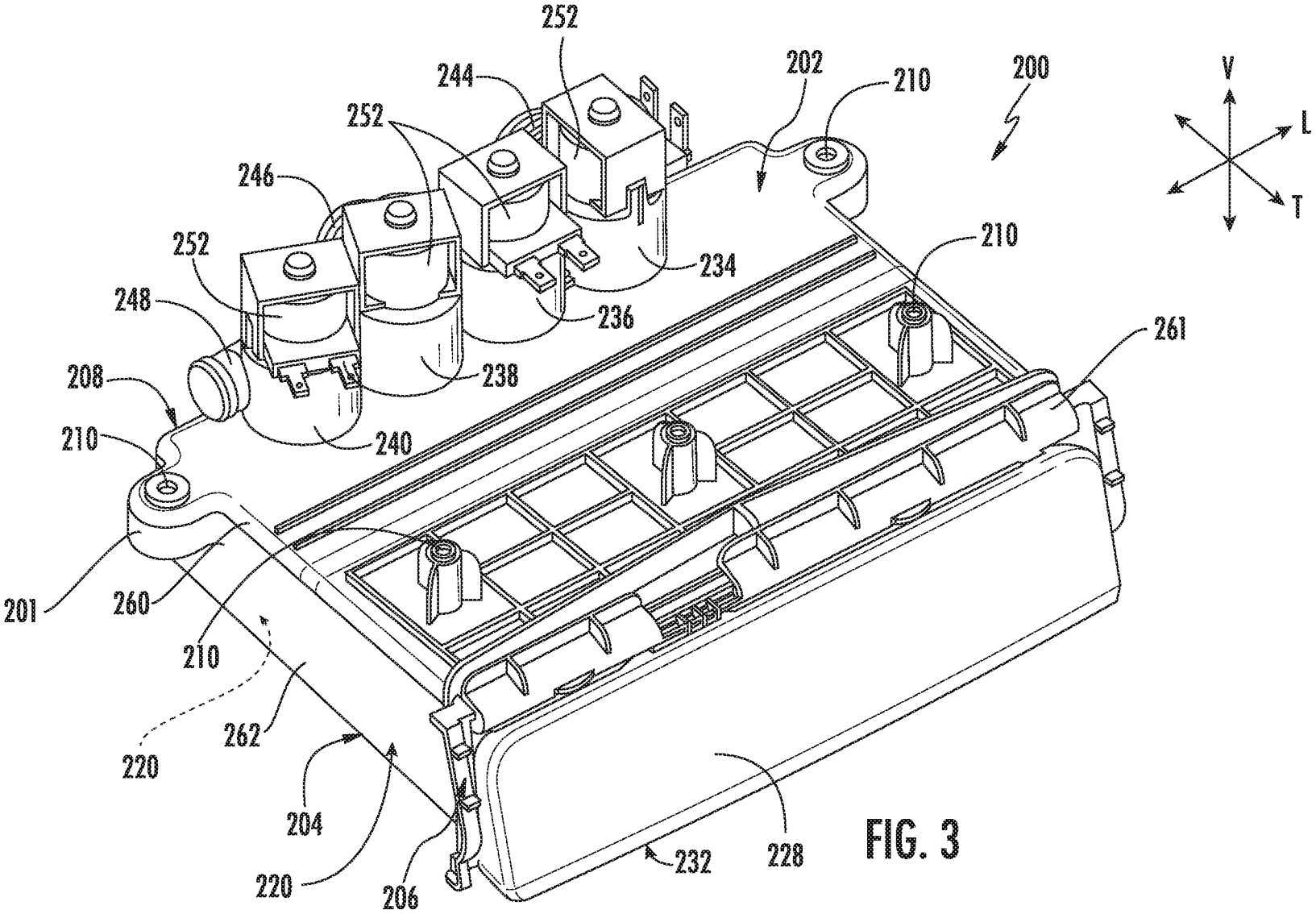
FIG. 3 provides a front, perspective view of an additive dispenser according to exemplary embodiments of the present disclosure.
Figure 4:
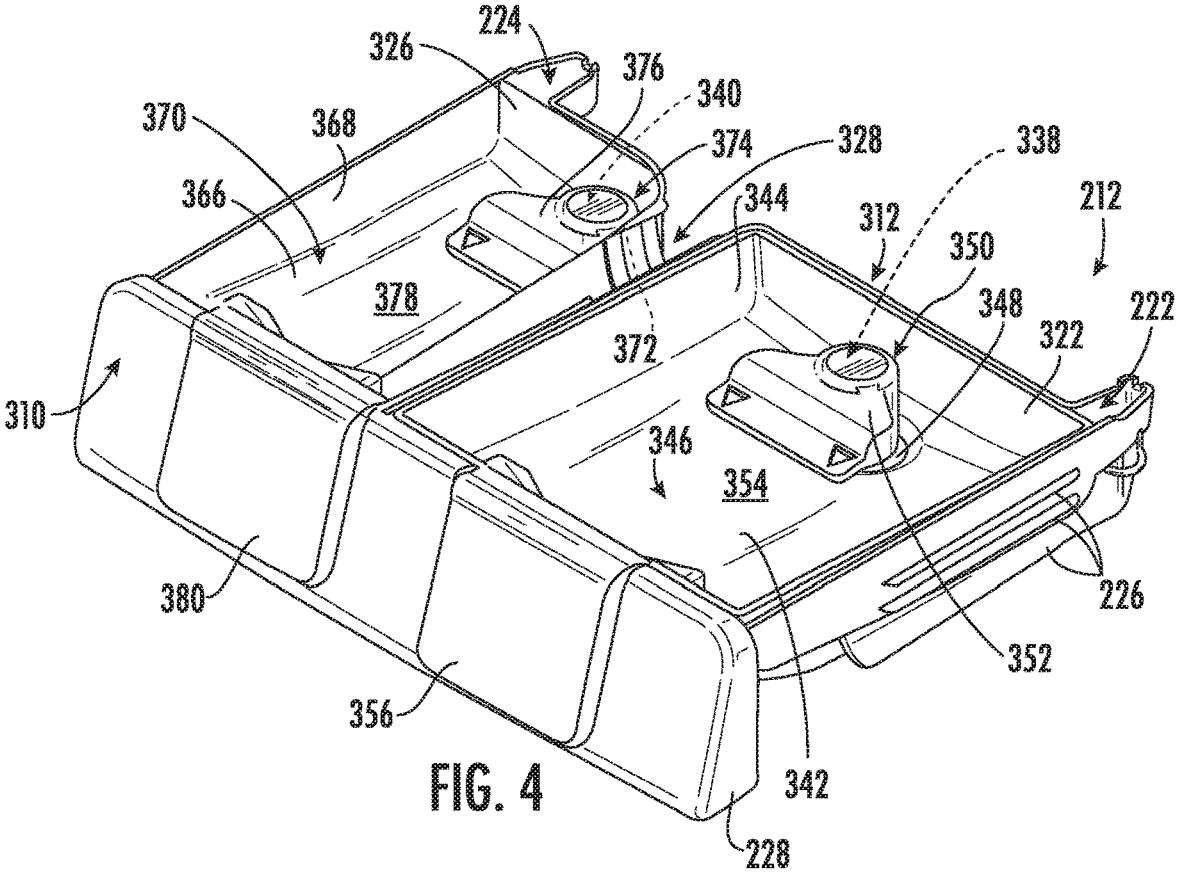
FIG. 4 provides a perspective view of a drawer of an additive dispenser, with a primary liquid cup and secondary liquid cup therein, according to exemplary embodiments of the present disclosure.
Figure 5:
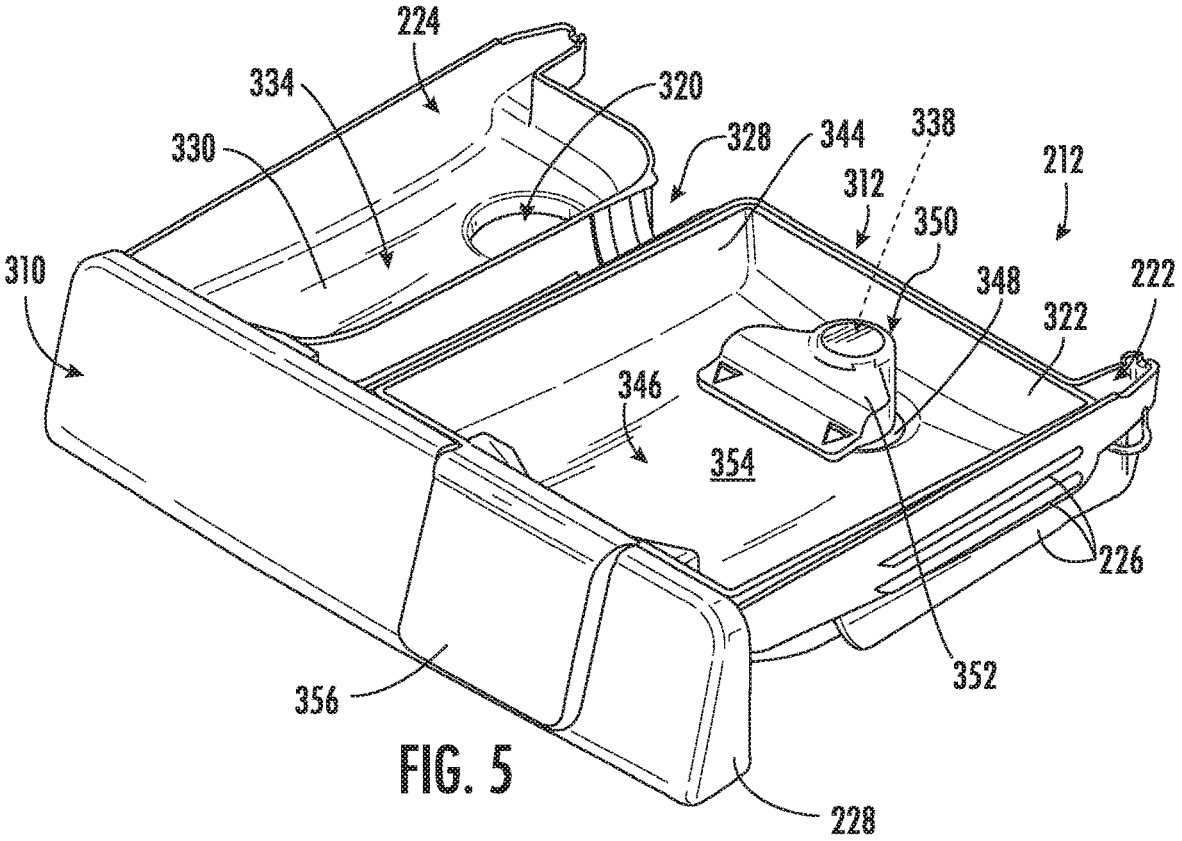
FIG. 5 provides a perspective view of the exemplary drawer of FIG. 4, wherein only the primary liquid cup is received therein.
Figure 6:
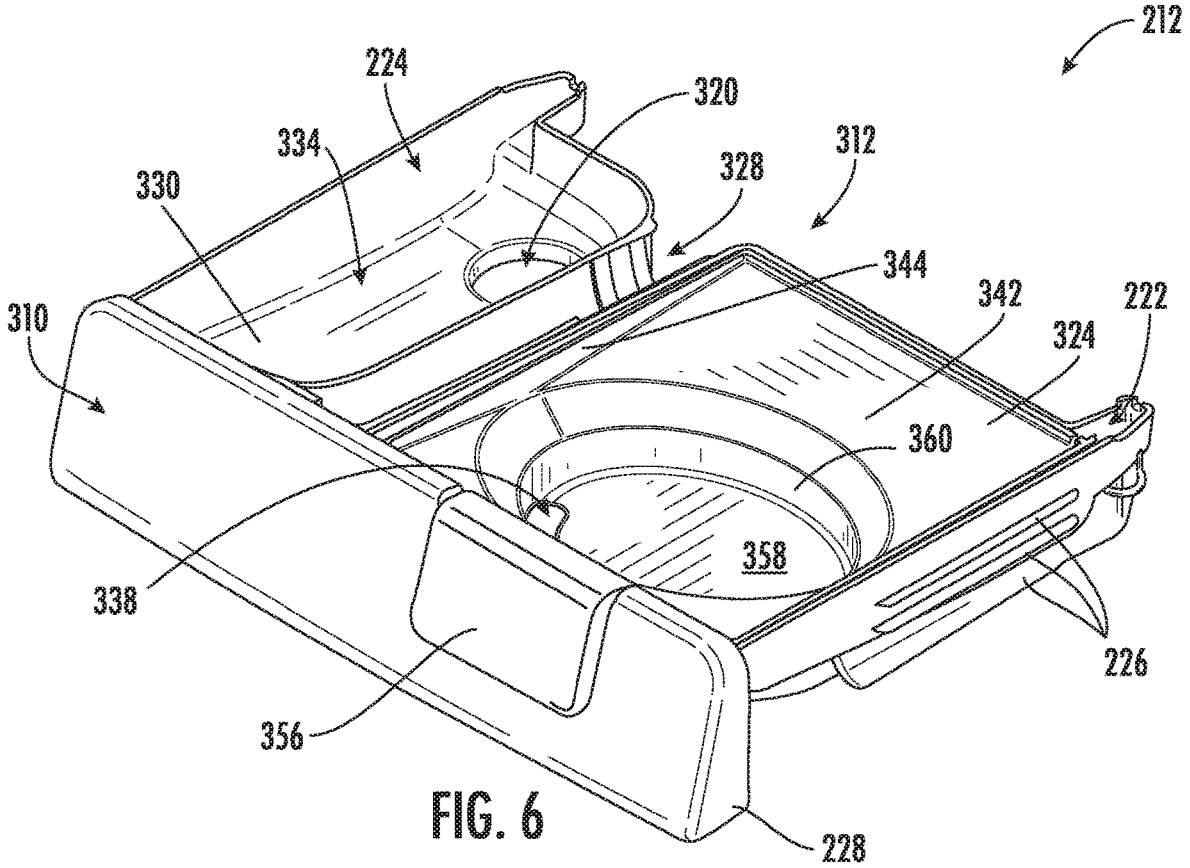
FIG. 6 provides a perspective view of the exemplary drawer of FIG. 4, wherein a primary pod cup is received therein.

Referring now generally to FIGS. 2 through 4, additive dispenser 200 will be described in more detail. Although the discussion below refers to additive dispenser 200, one skilled in the art will appreciate that the features and configurations described may be used for other additive dispensers in other washing appliances as well. For example, additive dispenser 200 may be positioned on a front of cabinet 102, may have a different shape or chamber configuration, and may dispense water, detergent, or other additives. Other variations and modifications of the exemplary embodiment described below are possible, and such variations are contemplated as within the scope of the present subject matter.

In exemplary embodiments, additive dispenser 200 has a housing 201 that generally forms a box (e.g., having a substantially rectangular cross-section) defining a top 202 and a bottom 204 spaced apart along the vertical direction V. Additive dispenser 200 also defines a front end 206 and a rear end 208 spaced apart along the transverse direction T. In some such embodiments, front end 206 is open (e.g., to permit a dispenser drawer 212 or wash fluid therethrough) while rear end 208 is closed (e.g., thereby restricting the passage of wash fluid from housing 201 at rear end 208). In certain embodiments, additive dispenser 200 includes an upper top plate 260 fixed to a lower base plate 262, which together selectively enclose or receive a dispenser drawer 212.

In some embodiments, additive dispenser 200 is mounted underneath top panel 140 of cabinet 102 such that front side 206 is visible inside opening 105. More specifically, additive dispenser 200 may be mounted to top panel 140 using a plurality of mounting features 210, which may, for example, be configured to receive mechanical fasteners. One skilled in the art will appreciate that additive dispenser 200 may be mounted in other locations and use other mounting means according to alternative exemplary embodiments.

As shown, additive dispenser 200 may include or define a mixing chamber 220 configured to receive one or more additive compartments. For example, according to the illustrated embodiments, mixing chamber 220 is defined by top plate 260 and base plate 262. Together, top plate 260 and base plate 262 are configured to slidably receive a dispenser drawer 212 defining multiple additive compartments (e.g., 222, 224).

As will be described in greater detail below, dispenser drawer 212 generally extends (e.g., along the transverse direction T) from a forward end 310 to a rearward end 312. When assembled, forward end 310 is generally positioned proximal to the rotation axis of basket 120 while rearward end 312 is positioned distal to the rotation axis of basket 120. Dispenser drawer 212 may define a primary (e.g., detergent) compartment 222 and a secondary (e.g., softener or rinse) compartment 224 (FIG. 4). In some embodiments, compartments 222, 224 are slidably connected to the mixing chamber 220 (e.g., as part of a dispenser drawer 212 having laterally-positioned slides 226) and are connected to a front panel 228 of additive dispenser 200. In certain embodiments, the dispenser drawer 212 is fixed to front panel 228 (e.g., to slide therewith along the transverse direction T). In this manner, a user may pull on front panel 228 to slide compartments 222, 224 or dispenser drawer 212 along the transverse direction T from a closed position (e.g., FIG. 3) to an open position (not pictured). Once extended, primary compartment 222 and secondary compartment 224 may be conveniently filled with a wash additive (e.g., liquid detergent, powder detergent, bleach, fabric softener, scent pellets, additive pods, rinse aid, etc.), either directly or, alternately, through a received primary cup (e.g., 322 or 324) or secondary cup (e.g., 326). From the open position, front panel 228 may then be pushed back into mixing chamber 220 (i.e., to the closed position) before a wash cycle begins. Along with permitting water into the compartments 222, 224, the closed position of additive dispenser 200 may restrict or inhibit user access to the compartments 222, 224.

Generally, housing 201 may define an exhaust opening 232 downstream from mixing chamber 220 or dispenser drawer 212 to direct wash fluid, such as water or a mixture of water and at least one wash additive (e.g., detergent, fabric softener, bleach, dissolved scent pellets, dissolved additive pod, etc.) into wash chamber 121 from additive dispenser 200. In some embodiments, exhaust opening 232 is defined through the bottom of mixing chamber 220 (e.g., on or through a bottom surface of base plate 262) to dispense the wash fluid into wash chamber 121. Optionally, exhaust opening 232 may be defined at an open front end 206. Additionally or alternatively, exhaust opening 232 may extend rearward from front end 206. When assembled such that dispenser drawer 212 is fully received within additive dispenser 200, at least a portion of dispenser drawer 212 may be positioned above and axially aligned with exhaust opening 232.

Additive dispenser 200 may further include one or more valves configured to supply hot or cold water to mixing chamber 220. For example, according to the illustrated embodiment, a plurality of apertures may be defined on top 202 of mixing chamber 220 (e.g., on top plate 260) for receiving water. Each receiving aperture may be in fluid communication with a different portion of the mixing chamber 220. A plurality of valve seats may be positioned over the top of each of those apertures to receive a valve that controls the flow of water through each receiving aperture.

For example, a first valve seat 234 may be in fluid communication with a first aperture for providing hot water into primary compartment 222 (e.g., during a wash cycle). A second valve seat 236 may be in fluid communication with a second aperture for providing cold water into primary compartment 222 (e.g., during a wash cycle). A third valve seat 238 may be in fluid communication with a third aperture for providing cold water into secondary compartment 224 (e.g., during a pre-wash cycle, post-wash cycle, or rinse cycle). A fourth valve seat 240 may be in fluid communication with a fourth aperture for providing cold water into mixing chamber 220 or directly into wash tub 121 (e.g., during a pre-wash cycle, wash cycle, post-wash cycle, or rinse cycle).

Water inlets may be placed in fluid communication with each of valve seats 234, 236, 238, 240. More specifically, a hot water inlet 244 may be connected to a hot water supply line (not shown) and a cold water inlet 246 may be connected to a cold water supply line (not shown). According to the illustrated embodiment, each water inlet 244, 246 may include a threaded male adapter configured for receiving a threaded female adapter from a conventional water supply line. However, any other suitable manner of fluidly connecting a water supply line and water inlets 244, 246 may be used. For example, each water supply line and water inlets 244, 246 may have copper fittings that may be sweated together to create a permanent connection.

Notably, hot water inlet 244 is in direct fluid communication with first valve seat 234. However, because washing machine appliance 100 uses cold water for multiple purposes, cold water inlet is in fluid communication with a cold water manifold 248. Optionally, cold water manifold 248 may be a cylindrical pipe that extends along the lateral direction from second valve seat 236 to fourth valve seat 240. In this manner, cold water manifold 248 places valve seats 236, 238, 240 in fluid communication with cold water inlet 246.

Each of valve seats 234, 236, 238, 240 may be configured to receive a water valve 252 for controlling the flow of water through a corresponding aperture into mixing chamber 220. Water valve 252 may be, for example, a solenoid valve that is electrically connected to controller 108. However, any other suitable water valve may be used to control the flow of water. Controller 108 may selectively open and close water valves 252 to allow water to flow from hot water inlet 244 through first valve seat 234 and from cold water manifold 248 through one or more of second valve seat 236, third valve seat 238, and fourth valve seat 240.

In some embodiments, a shower plate 261 is mounted within mixing chamber 220 (e.g., fixedly mounted above compartments 222, 224) to distribute water therethrough. When assembled such that dispenser drawer 212 is fully received within additive dispenser 200, shower plate 261 may be positioned directly above dispenser drawer 212. Moreover, shower plate 261 may be directly beneath the valve seats 234, 236, 238, 240 and their corresponding openings through top plate 260.

Turning especially to FIGS. 4 through 9, an exemplary dispenser drawer 212 of additive dispenser 200 is illustrated. Generally, dispenser drawer 212 may be slidably mounted to housing 201 (e.g., top plate 260 or base plate 262) to move relative thereto (e.g., along the transverse direction T).

As shown, dispenser drawer 212 defines a discrete primary compartment 222 and secondary compartment 224. In particular, secondary compartment 224 is spaced apart from primary compartment 222 (e.g. along the lateral direction L) such that separate wash additives may be contained therein (e.g., to dispense discrete first and secondary wash fluids from primary and secondary compartments 222, 224, respectively). Optionally, an open void (e.g., lateral void 328) may separate primary and secondary compartments 222, 224, advantageously preventing different wash additives from mixing or being exchanged between primary and secondary compartments 222, 224. During use, the primary wash fluid may thus be selectively dispensed from primary compartment 222 separately and at a different time/cycle from the secondary wash fluid selectively dispensed from secondary compartment 224.

Each compartment 222 and 224 defines at least one corresponding outlet upstream from exhaust opening 232 or mixing chamber 220. In other words, dispenser drawer 212 defines a primary outlet (e.g., primary front outlet 314 or primary rear outlet 316) extending from primary compartment 222 to direct the primary wash fluid to basket 120 (FIG. 2), as well as a secondary outlet (e.g., secondary front outlet 318 or secondary rear outlet 320) extending from secondary compartment 224 to direct the secondary wash fluid to basket 120.

In some embodiments, primary compartment 222 has two discrete outlets. For instance, a primary front outlet 314 may be defined proximal to the forward end 310 while a primary rear outlet 316 is defined proximal to rearward end 312. Primary front outlet 314 may be spaced apart from primary rear outlet 316 (e.g., horizontally, such as along the transverse direction T). Moreover, primary front outlet 314 or primary rear outlet 316 may extend vertically through a bottom wall 330 of dispenser drawer 212 (e.g., a bottom surface 332 of primary compartment 222). Optionally, the bottom surface 332 of primary compartment 222 may be sloped (e.g., downward from rearward end 312 to forward end 310). Thus, primary front outlet 314 may be disposed lower than primary rear outlet 316 (e.g., to generally direct water or wash fluid along bottom surface 332 toward forward end 310).

Generally, primary front outlet 314 or primary rear outlet 316 may be defined with any suitable profile or cross-sectional area (e.g., perpendicular to the vertical direction V). In the illustrated embodiments, primary front outlet 314 is defined as a curved arc (i.e., according to an arcuate profile or outline in the plane perpendicular to the vertical direction V). In some such embodiments, the tip or crest of the curved arc is disposed proximal to forward end 310 (i.e., forward from the two endpoints of the arc). Optionally, an internal rim 336 may extend about primary front outlet 314 such that the bottom wall 330 of dispenser drawer 212 forms a recessed or open pocket (e.g., within which an additive pod or cup may be received). In additional or alternative embodiments, primary rear outlet 316 is defined as a circle (i.e., according to a circular profile or outline in the plane perpendicular to the vertical direction V or bottom surface 332).

As shown, primary front outlet 314 may define a larger cross section than primary rear outlet 316. In other words, the cross-sectional area of primary front outlet 314 (e.g., perpendicular to the vertical direction V or bottom surface 332) may be greater than the cross-sectional area of primary rear outlet 316.

When assembled such that dispenser drawer 212 is fully received within additive dispenser 200, primary front outlet 314 may be positioned above and axially aligned with exhaust opening 232. Primary wash fluid exiting primary front outlet 314 may thus flow directly through exhaust opening 232 (e.g., and into basket 120) without collecting first within mixing chamber 220 or on an internal surface of housing 201. By contrast, primary rear outlet 316 may be positioned within housing 201 rearward from exhaust opening 232. When assembled, primary rear outlet 316 may be enclosed within housing 201. Primary wash fluid exiting primary rear outlet 316 may thus flow to mixing chamber 220 (e.g., collect on a lower internal surface of housing 201) before flowing through exhaust opening 232 (e.g., and into basket 120).

In some embodiments, secondary compartment 224 has two discrete outlets. For instance, a secondary front outlet 318 may be defined proximal to the forward end 310 while a secondary rear outlet 320 is defined proximal to rearward end 312. Secondary front outlet 318 may be spaced apart from secondary rear outlet 320 (e.g., horizontally, such as along the transverse direction T). Moreover, secondary front outlet 318 or secondary rear outlet 320 may extend vertically through a bottom wall 330 of dispenser drawer 212 (e.g., a bottom surface 334 of secondary compartment 224). Optionally, the bottom surface 334 of secondary compartment 224 may be sloped (e.g., downward from rearward end 312 to forward end 310). Thus, secondary front outlet 318 may be disposed lower than secondary rear outlet 320 (e.g., to generally direct water or wash fluid along bottom surface 334 toward forward end 310).

Generally, secondary front outlet 318 or secondary rear outlet 320 may be defined with any suitable profile or cross-sectional area (e.g., perpendicular to the vertical direction V). In the illustrated embodiments, secondary front outlet 318 is generally defined as a rectangle (i.e., according to a generally rectangular profile or outline in the plane perpendicular to the vertical direction V). In some such embodiments, a maximum length of the rectangle is parallel to the lateral direction L while a minimum length of the rectangle is parallel to the transverse direction T. Optionally, an internal grid or grate (not pictured) may extend across secondary front outlet 318 such that larger solid additives (e.g., undissolved scent pellets) may prevented from passing through secondary front outlet 318 while permitted liquids (e.g., water or wash fluid) therethrough. In additional or alternative embodiments, secondary rear outlet 320 is defined as a circle (i.e., according to a circular profile or outline in the plane perpendicular to the vertical direction V or bottom surface 334).

As shown, secondary front outlet 318 may define a larger cross section than secondary rear outlet 320. In other words, the cross-sectional area of secondary front outlet 318 (e.g., perpendicular to the vertical direction V or bottom surface 334) may be greater than the cross-sectional area of secondary rear outlet 320.

When assembled such that dispenser drawer 212 is fully received within additive dispenser 200, secondary front outlet 318 may be positioned above and axially aligned with exhaust opening 232. Secondary wash fluid exiting secondary front outlet 318 may thus flow directly through exhaust opening 232 (e.g., and into basket 120) without collecting first within mixing chamber 220 or on an internal surface of housing 201. By contrast, secondary rear outlet 320 may be positioned within housing 201 rearward from exhaust opening 232. Secondary rear outlet 320 may be enclosed within housing 201. Secondary wash fluid exiting secondary rear outlet 320 may thus flow to mixing chamber 220 (e.g., collect on a lower internal surface of housing 201) before flowing through exhaust opening 232 (e.g., and into basket 120).

Turning now to FIGS. 4 through 13, various portions of additive dispenser 200; including dispenser drawer 212 and one or more cups (e.g., 322, 324, or 326); will be discussed in greater detail. As illustrated, one or more cups may generally be provided for selective reception on dispenser drawer 212 (e.g., based on what type(s) of wash additive is/are desired for a given washing operation). As an example, one or more primary cups (e.g., primary liquid cup 322 or primary pod cup 324) may be selectively received (e.g., one at a time) within primary compartment 222. The primary cup generally defines at least one vertical opening 338 through which a first wash additive may be permitted to flow (e.g., with water as part of the primary wash fluid) to or through the primary compartment 222 upstream from a primary outlet (e.g., primary front outlet 314 or primary rear outlet 316). As an additional or alternative example, one or more secondary cups (e.g., secondary liquid cup 326) may be selectively received (e.g., one at a time) within secondary compartment 224. The secondary cup generally defines at least one vertical opening 340 through which a second wash additive may be permitted to flow (e.g., with water as part of the secondary wash fluid) to or through the secondary compartment 224 upstream from a secondary outlet (e.g., secondary front outlet 318 or secondary rear outlet 320).

It is noted that although a portion of primary or secondary wash fluids may flow through a vertical opening of a corresponding cup, during use, another portion of the primary or secondary wash fluids may flow over one or more sidewalls of a corresponding cup (e.g., to or over a rear edge of dispenser drawer 212) and to mixing chamber 220 before flowing through exhaust opening 232 (e.g., and into basket 120).

In some embodiments, a primary liquid cup 322 can be selectively received on dispenser drawer 212 within primary compartment 222. Thus, a user may insert primary liquid cup 322 into primary compartment 222 and remove primary liquid cup 322 from primary compartment 222 as desired (e.g., based on the type of wash additive to be used in a given washing operation).

As shown, primary liquid cup 322 generally includes one or more cup walls (e.g., base wall 342 and sidewalls 344) defining an open liquid chamber 354. Specifically, the cup walls provide an inner surface 346 that may form a concave profile that delineates or bounds open liquid chamber 354 to hold a liquid wash additive (e.g., detergent) therein. A cup siphon 348 that defines vertical opening 338 may extend upward from inner surface 346. In particular, cup siphon 348 may extend to an open end 350 maintained at a maximum liquid height. Liquid additive within open liquid chamber 354 may thus be held therein below the maximum liquid height. Optionally, a fill cap 352 may disposed on cup siphon 348 (e.g., at the open end 350 to indicate that liquid within open liquid chamber 354 has nearly exceeded the maximum liquid height). As would be understood, fill cap 352 may define a radial channel about cup siphon 348 such that liquid rising above the maximum liquid height may be permitted to pass through the radial channel and to vertical opening 338. Moreover, cup siphon 348 may help motivate or draw wash fluid therethrough (e.g., once the siphon action is initiated, as would be understood). Additionally or alternatively, a front flap 356 may extend forward from cup walls. For example, front flap 356 may be formed with an inner profile that is complementary to front panel 228 to rest thereon.

When assembled such that primary liquid cup 322 is received within primary compartment 222, cup siphon 348 and vertical opening 338 are aligned with (e.g., above) primary rear outlet 316. Open liquid chamber 354 may be positioned below shower plate 261 (e.g., downstream therefrom). During use, water may flow to open liquid chamber 354 and mix with a first liquid additive as primary wash fluid. As water continues to flow, primary wash fluid may exceed the maximum liquid height and pass through vertical opening 338. From vertical opening 338, primary wash fluid may pass directly through primary rear outlet 316 and to mixing chamber 220 (e.g., prior to flowing to basket 120—FIG. 2).

In some embodiments, a primary pod cup 324 can be selectively received on dispenser drawer 212 within primary compartment 222. Thus, a user may insert primary pod cup 324 into primary compartment 222 and remove primary pod cup 324 from primary compartment 222 as desired (e.g., based on the type of wash additive to be used in a given washing operation).

As shown, primary pod cup 324 generally includes one or more cup walls (e.g., base wall 342 and sidewalls 344) defining an open pod chamber 358. Specifically, the cup walls provide an inner surface 346 that may form a concave profile that delineates or bounds open pod chamber 358 to hold an additive pod therein. Optionally, an internal pod rim 360 may extend about the vertical opening 338 such that the base wall 342 of primary pod cup 324 forms a recessed or open pod pocket (e.g., complementary to the pocket formed by dispenser drawer 212 and within which an additive pod may be received).

Generally, the vertical opening 338 of primary pod cup 324 may be defined with any suitable profile or cross-sectional area (e.g., perpendicular to the vertical direction V). In the illustrated embodiments, the vertical opening 338 is defined as a curved arc (i.e., according to an arcuate profile or outline in the plane perpendicular to the vertical direction V). In some such embodiments, the tip or crest of the curved arc is disposed proximal to forward end 310 (i.e., forward from the two endpoints of the arc).

Optionally, one or more support ribs 362 may extend (e.g., horizontally) across a portion of vertical opening 338. For instance, multiple support ribs 362 may be spaced apart from each other and extend from a forward edge of vertical opening 338. Such support ribs 362 may include corresponding free ends 364 that are spaced apart from the rearward edge of vertical opening 338. Advantageously, an undissolved additive pod within open pod chamber 358 may be prevented from passing through vertical opening 338 while partially-dissolved pod casings or portions may be permitted therethrough (e.g., without being caught or stuck by support ribs 362). Additionally or alternatively, a front flap 356 may extend forward from cup walls. For example, front flap 356 may be formed with an inner profile that is complementary to front panel 228 to rest thereon.

When assembled such that primary pod cup 324 is received within primary compartment 222, the vertical opening 338 may be aligned with (e.g., above) primary front outlet 314 and exhaust opening 232. Primary front outlet 314 may be aligned below the vertical opening 338 of primary pod cup 324. The cross section of the vertical opening 338 of primary pod cup 324 may mirror or be coaxial with the cross section of primary front outlet 314. Moreover, the cross section of the vertical opening 338 of primary pod cup 324 may smaller than the cross section of primary outlet 314. A rearward portion of primary pod cup 324 (e.g., a solid portion of base wall 342) may cover primary rear outlet 316. Open pod chamber 358 may be positioned below shower plate 261 (e.g., downstream therefrom). During use, water may flow to open pod chamber 358, dissolve an additive pod, and mix with the contents of additive pod as primary wash fluid. As water continues to flow, the primary wash fluid passes through vertical opening 338 and may continue directly through exhaust opening 232 (e.g., prior to flowing to basket 120—FIG. 2).

In certain embodiments, a primary liquid cup 322 and a primary pod cup 324 may be selectively or alternately received on dispenser drawer 212 within primary compartment 222. Optionally, primary liquid cup 322 and primary pod cup 324 may be provided as part of a dispenser kit and can be exchanged for each other. Thus, additive dispenser 200 may operate in multiple discrete conditions (e.g., based on the type wash additive to be used within primary compartment 222 for a given washing operation).

One condition may be a primary liquid additive condition (e.g., for a liquid first additive as the first additive—FIGS. 4 and 5) including primary liquid cup 322 on dispenser drawer 212 within primary compartment 222 to receive a liquid wash additive therein. In the primary liquid additive condition, primary pod cup 324 is generally unused and, thus, may be held apart from or outside of additive dispenser 200.

Another condition may be a pod additive condition (e.g., for an additive pod as the first additive—FIG. 6) including primary pod cup 324 on dispenser drawer 212 within primary compartment 222 to receive an additive pod therein. In the pod additive condition, primary liquid cup 322 is generally unused and, thus, may be held apart from or outside of additive dispenser 200.

Figure 7:
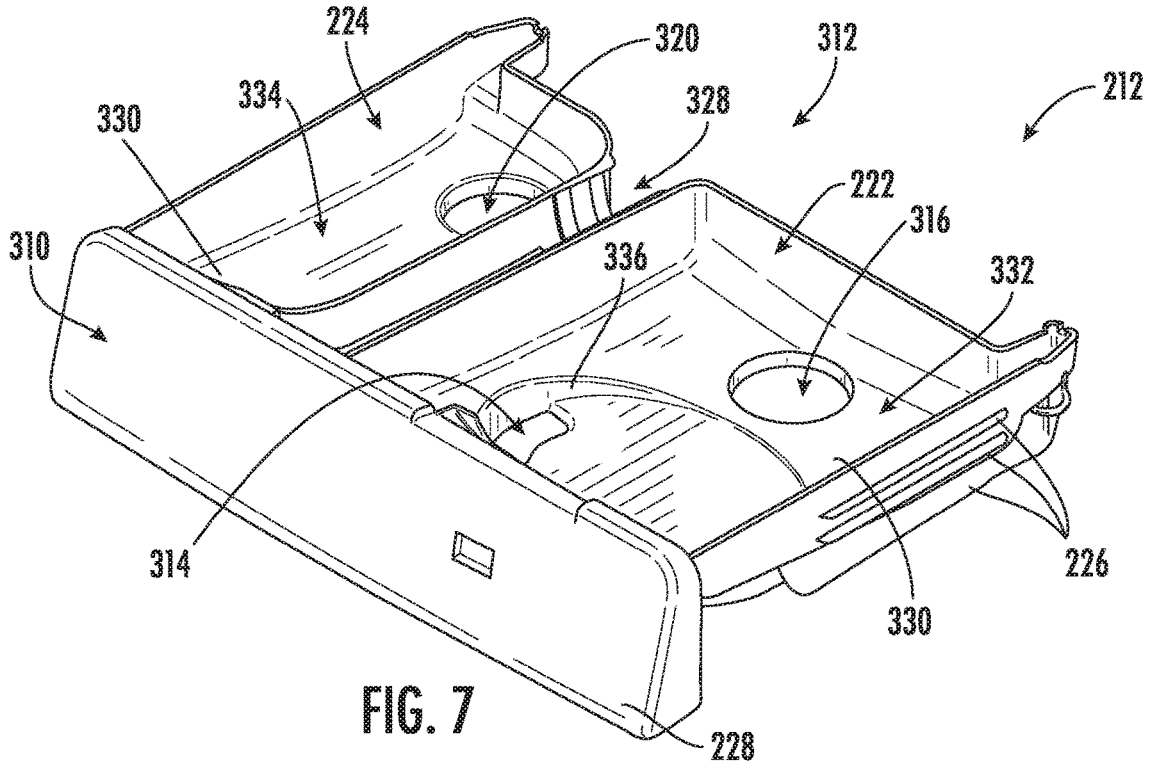
FIG. 7 provides a perspective view of the exemplary drawer of FIG. 4, wherein no primary or secondary cup is received therein.
Figure 8:
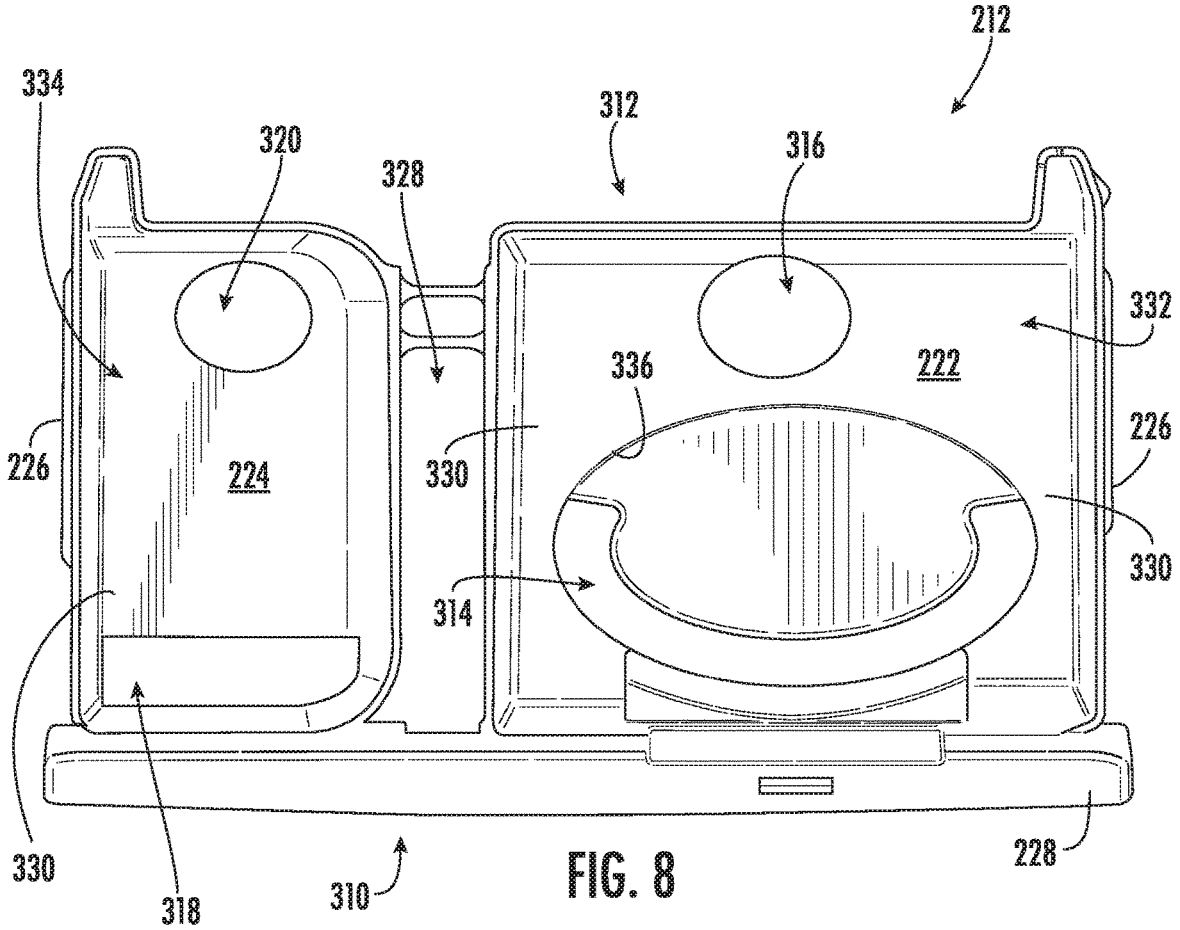
FIG. 8 provides a top perspective view of the exemplary drawer of FIG. 7.
Figure 9:
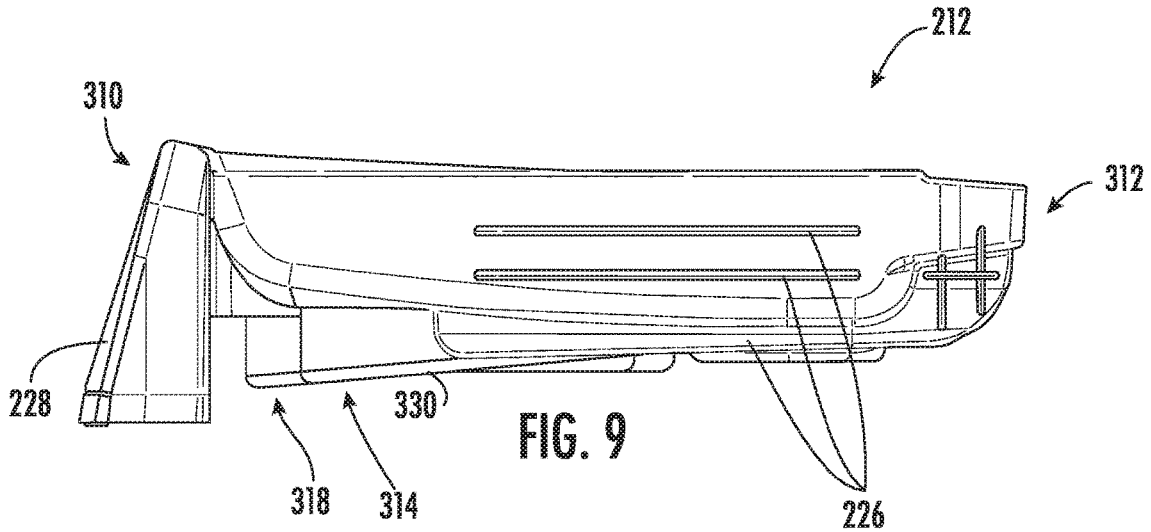
FIG. 9 provides a side elevation view of the exemplary drawer of FIG. 7.
Figure 10:
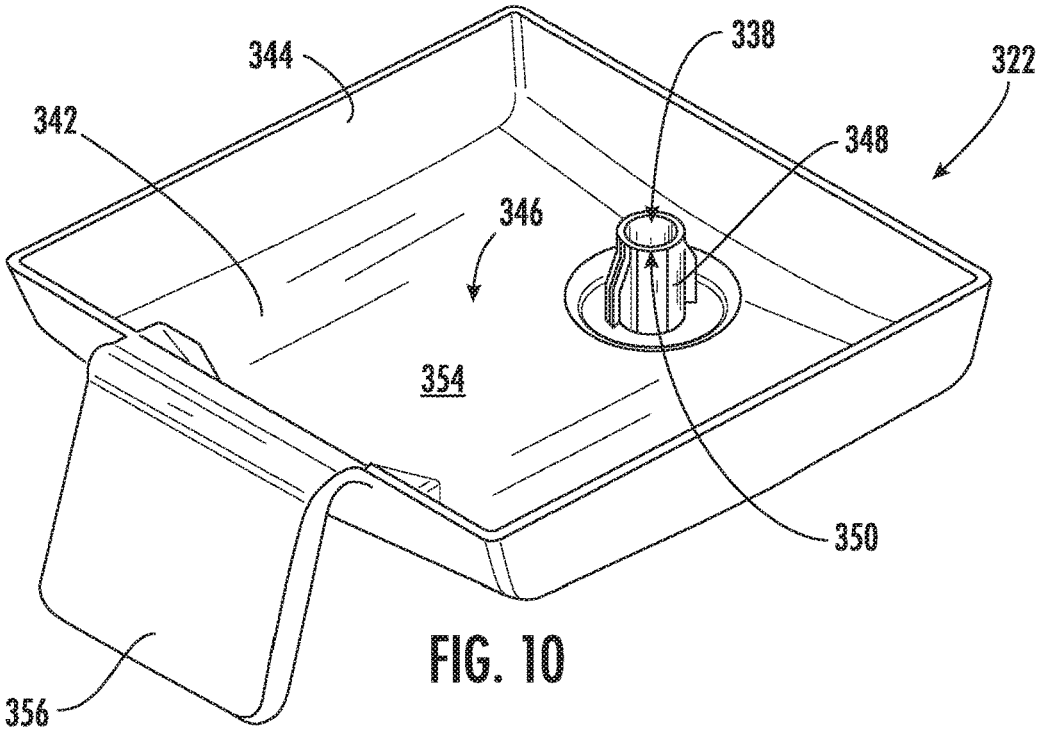
FIG. 10 provides a perspective view of the exemplary primary liquid cup of FIG. 4.
Figure 11:
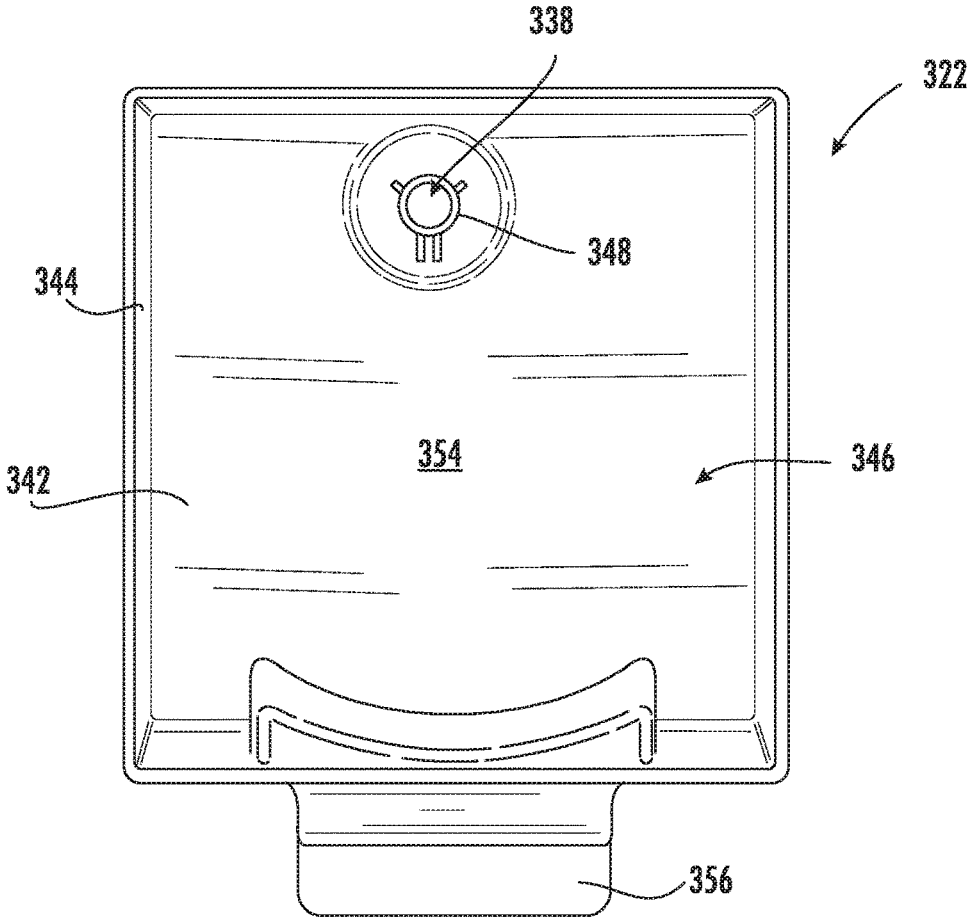
FIG. 11 provides a top perspective view of the exemplary primary liquid cup of FIG. 4.
Figure 12:
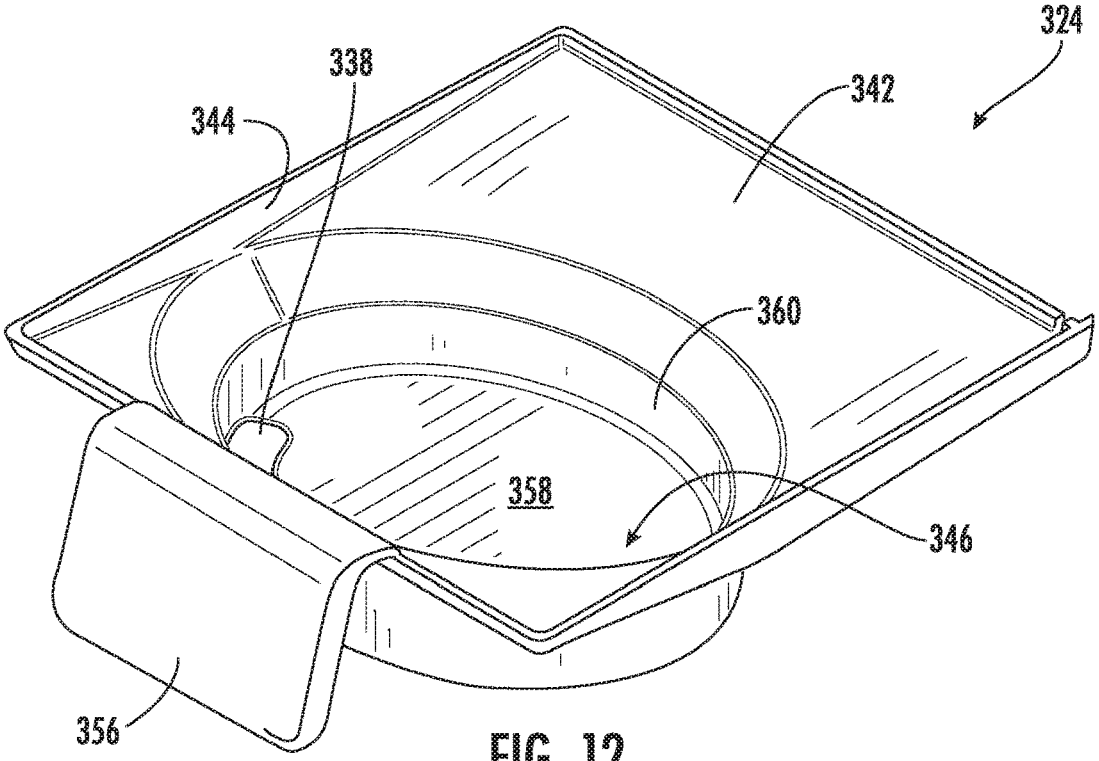
FIG. 12 provides a perspective view of the exemplary primary pod cup of FIG. 6.
Figure 13:
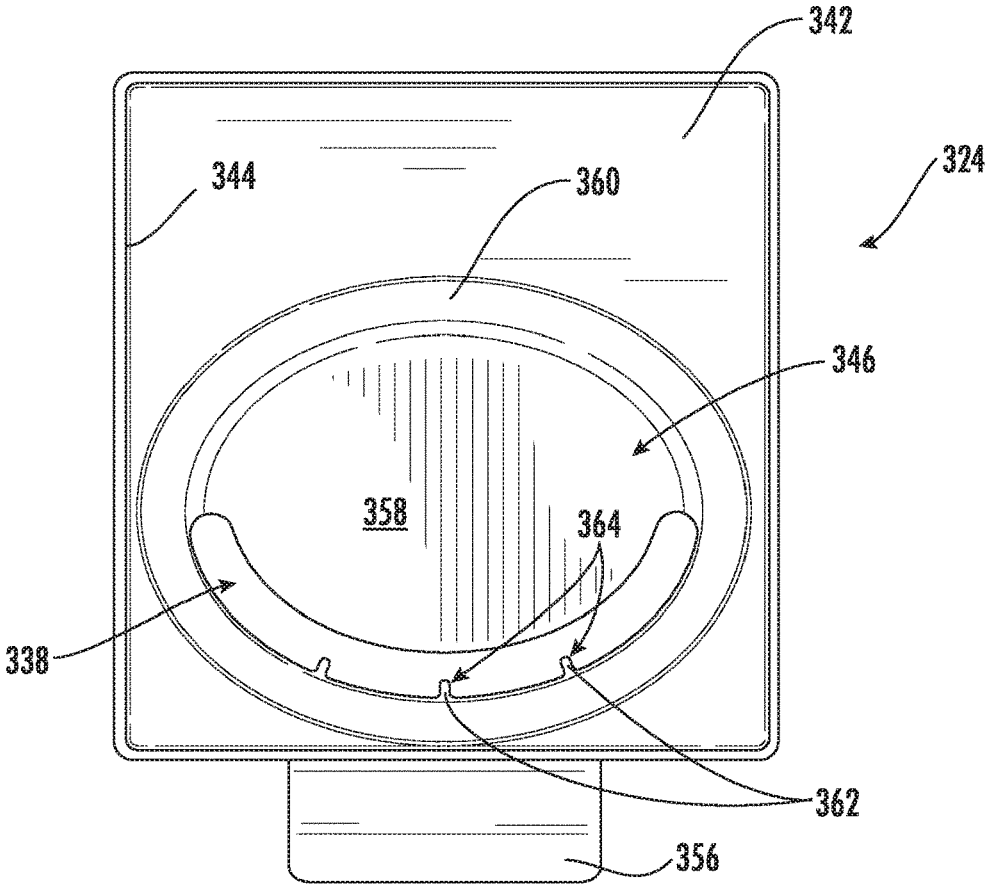
FIG. 13 provides a perspective view of the exemplary primary pod cup of FIG. 6.

Yet another condition may be a general or large-pod condition (e.g., for a powder additive or relatively large additive pod as the first additive—FIGS. 7 and 8) wherein no cup (e.g., neither primary liquid cup 322 or primary pod cup 324) is within primary compartment 222. The first wash additive may be supplied directly to the bottom surface 332 of primary compartment 222. In the general or large-pod condition, both primary liquid cup 322 and primary pod cup 324 are generally unused and, thus, may be held apart from or outside of additive dispenser 200.

Different cups (or selective absence thereof) may advantageously permit different wash additives to be supplied, preloaded, or otherwise used within corresponding primary compartment 222 (e.g., to ensure such wash additives are appropriately stored within and dispensed from dispenser drawer 212).

In some embodiments, a secondary liquid cup 326 can be selectively received on dispenser drawer 212 within secondary compartment 224. Thus, a user may insert secondary liquid cup 326 into secondary compartment 224 and remove secondary liquid cup 326 from secondary compartment 224 as desired (e.g., based on the type of wash additive to be used in a given washing operation).

As shown, secondary liquid cup 326 generally includes one or more cup walls (e.g., base wall 366 and sidewalls 368) defining an open liquid chamber 378. Specifically, the cup walls provide an inner surface 370 that may form a concave profile that delineates or bounds open liquid chamber 378 to hold a liquid wash additive therein (e.g., fabric softener). A cup siphon 372 that defines vertical opening 340 may extend upward from inner surface 370. In particular, cup siphon 372 may extend to an open end 374 maintained at a maximum liquid height (e.g., similar to cup siphon 348—FIG. 10). Liquid additive within open liquid chamber 378 may thus be held therein below the maximum liquid height. Optionally, a fill cap 376 may be disposed on cup siphon 372 (e.g., at the open end 374 to indicate that liquid within open liquid chamber 378 has nearly exceeded the maximum liquid height). As would be understood, fill cap 376 may define a radial channel about cup siphon 372 such that liquid rising above the maximum liquid height may be permitted to pass through the radial channel and to vertical opening 340. Moreover, cup siphon 372 may help motivate or draw wash fluid therethrough (e.g., once the siphon action is initiated, as would be understood). Additionally or alternatively, a front flap 380 may extend forward from cup walls. For example, front flap 380 may be formed with an inner profile that is complementary to front panel 228 to rest thereon.

When assembled such that secondary liquid cup 326 is received within secondary compartment 224, cup siphon 372 and vertical opening 340 are aligned with (e.g., above) secondary rear outlet 320. Open liquid chamber 378 may be positioned below shower plate 261 (e.g., downstream therefrom). During use, water may flow to open liquid chamber 378 and mix with a second liquid additive as secondary wash fluid. As water continues to flow, secondary wash fluid may exceed the maximum liquid height and pass through vertical opening 340. From vertical opening 340, secondary wash fluid may pass directly through secondary rear outlet 320 and to mixing chamber 220 (e.g., prior to flowing to basket 120—FIG. 2).

In certain embodiments, a secondary cup (e.g., secondary liquid cup 326) may be selectively received on dispenser drawer 212 within secondary compartment 224. Optionally, secondary liquid cup 326 may be provided as part of a dispenser kit (e.g., with or separate from one or more primary cups). Thus, additive dispenser 200 may operate in multiple discrete conditions (e.g., based on the type wash additive to be used within secondary compartment 224 for a given washing operation).

One condition may be a secondary liquid additive condition (e.g., for a liquid second additive as the second additive—FIG. 4) including secondary liquid cup 326 on dispenser drawer 212 within secondary compartment 224 to receive a liquid wash additive therein.

Yet another condition may be a solid or additive-free condition (e.g., for relatively large pellet additives as the second additive, or no additives within secondary compartment 224—FIGS. 5 through 8) wherein no cup (e.g., no secondary cup) is within secondary compartment 224. A second wash additive may be supplied directly to the bottom surface 334 of secondary compartment 224. In the solid or additive-free condition, secondary liquid cup 326 is generally unused and, thus, may be held apart from or outside of additive dispenser 200.

Different cups (or selective absence thereof) may advantageously permit different wash additives to be supplied, preloaded, or otherwise used within corresponding secondary compartment 224 (e.g., to ensure such wash additives are appropriately stored within and dispensed from dispenser drawer 212).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance, comprising:

a cabinet having a top panel, the top panel of the cabinet defining an opening;

a tub disposed within the cabinet below the top panel, the tub defining a wash chamber;

a basket rotatably mounted within the tub; and a fluid additive dispenser comprising a housing mounted below the top panel, the housing defining a bottom exhaust opening, a dispenser drawer selectively received in the housing above the basket, the dispenser drawer defining a primary compartment and a secondary compartment, the dispenser drawer further defining a primary outlet extending from the primary compartment to direct a primary wash fluid to the basket and a secondary outlet extending from the secondary compartment to direct a secondary wash fluid to the basket, a primary cup selectively received on the dispenser drawer within the primary compartment to hold a first wash additive therein, the primary cup defining a vertical opening therethrough to permit the first wash additive to the primary compartment upstream from the primary outlet, and a secondary cup selectively received on the dispenser drawer within the secondary compartment to hold a second wash additive therein, the secondary cup defining a vertical opening therethrough to permit the second wash additive to the secondary compartment upstream from the secondary outlet, wherein the primary cup is a pod cup to receive an additive pod therein, and wherein the vertical opening of the primary cup is aligned above the bottom exhaust opening.

2. The washing machine appliance of claim 1, wherein the basket defines a rotation axis, wherein the dispenser drawer extends from a forward end proximal to the rotation axis to a rearward end distal to the rotation axis, wherein the primary outlet is a primary front outlet proximal to the forward end, and wherein the dispenser drawer further defines a primary rear outlet extending vertically to further direct the primary wash fluid to the basket.

3. The washing machine appliance of claim 2, wherein the primary front outlet defines a larger cross section than the primary rear outlet.

4. The washing machine appliance of claim 2, wherein the housing defines a bottom exhaust opening, wherein the primary front outlet is positioned above the bottom exhaust opening, and wherein the primary rear outlet is positioned within the housing rearward from the bottom exhaust opening.

5. The washing machine appliance of claim 2, wherein the primary front outlet is aligned below the vertical opening of the primary cup, and wherein the pod cup covers the primary rear outlet.

6. The washing machine appliance of claim 1, wherein the basket defines a rotation axis, wherein the dispenser drawer extends from a forward end proximal to the rotation axis to a rearward end distal to the rotation axis, wherein the secondary outlet is a front secondary outlet proximal to the forward end, and wherein the dispenser drawer further defines a secondary rear outlet extending vertically to further direct the secondary wash fluid to the basket.

7. The washing machine appliance of claim 6, wherein the front secondary outlet defines a larger cross section than the secondary rear outlet.

8. The washing machine appliance of claim 1, wherein the secondary cup includes a cup siphon extending upward from an inner surface of the primary cup, and wherein the cup siphon defines the vertical opening of the secondary cup.

9. A washing machine appliance, comprising:

a cabinet having a top panel, the top panel of the cabinet defining an opening;

a tub disposed within the cabinet below the top panel, the tub defining a wash chamber;

a basket rotatably mounted within the tub; and a fluid additive dispenser comprising a housing extending between an open front end and a closed rear end, the housing defining a bottom exhaust opening at the open front end, the housing being mounted below the top panel, a dispenser drawer slidably received in the housing above the basket, the dispenser drawer defining a primary compartment and a secondary compartment spaced apart from the primary compartment by a lateral void, the dispenser drawer further defining a primary outlet extending from the primary compartment to direct a primary wash fluid to the basket and a secondary outlet extending from the secondary compartment to direct a secondary wash fluid to the basket, a primary pod cup selectively received in the dispenser drawer within the primary compartment to hold an additive pod therein, the primary pod cup defining a vertical pod opening therethrough, the primary pod cup comprising one or more support ribs extending across a portion of the vertical pod opening to prevent undissolved additive pod from passing through vertical pod opening and to permit partially-dissolved pod casings or portions of additive pod to pass through the vertical pod opening to the primary compartment upstream from the primary outlet, and a secondary cup selectively received on the dispenser drawer within the secondary compartment to hold a second wash additive therein, the secondary cup defining a vertical opening therethrough to permit the second wash additive to the secondary compartment upstream from the secondary outlet.

10. The washing machine appliance of claim 9, wherein the basket defines a rotation axis, wherein the dispenser drawer extends from a forward end proximal to the rotation axis to a rearward end distal to the rotation axis, wherein the primary outlet is a primary front outlet proximal to the forward end, and wherein the dispenser drawer further defines a primary rear outlet extending vertically to further direct the primary wash fluid to the basket.

11. The washing machine appliance of claim 10, wherein the primary front outlet defines a larger cross section than the primary rear outlet.

12. The washing machine appliance of claim 10, wherein the primary front outlet is positioned above the bottom exhaust opening, and wherein the primary rear outlet is positioned within the housing rearward from the bottom exhaust opening.

13. The washing machine appliance of claim 10, wherein the primary front outlet is aligned below the vertical opening of the primary pod cup, and wherein the primary pod cup covers the primary rear outlet.

14. The washing machine appliance of claim 9, wherein the basket defines a rotation axis, wherein the dispenser drawer extends from a forward end proximal to the rotation axis to a rearward end distal to the rotation axis, wherein the secondary outlet is a front secondary outlet proximal to the forward end, and wherein the dispenser drawer further defines a secondary rear outlet extending vertically to further direct the secondary wash fluid to the basket.

15. The washing machine appliance of claim 14, wherein the front secondary outlet defines a larger cross section (e.g., diameter) than the secondary rear outlet.

16. The washing machine appliance of claim 9, wherein the secondary cup includes a cup siphon extending upward from an inner surface of the secondary cup, and wherein the cup siphon defines the vertical opening of the secondary cup.

* * * * *